US007250586B2

(12) United States Patent
Diemer et al.

(10) Patent No.: US 7,250,586 B2
(45) Date of Patent: Jul. 31, 2007

(54) SURFACE HEATING SYSTEM AND METHOD FOR PRODUCING IT AND A HEATABLE OBJECT

(75) Inventors: Stephan Diemer, Alsheim (DE); Michael Diemer, Jönköping (SE)

(73) Assignee: Braincom AG, Munich (DE)

( * ) Notice: Subject to any disclaimer, the term of this patent is extended or adjusted under 35 U.S.C. 154(b) by 0 days.

(21) Appl. No.: 10/464,822

(22) Filed: Jun. 18, 2003

(65) Prior Publication Data

US 2004/0036325 A1 Feb. 26, 2004

Related U.S. Application Data

(63) Continuation of application No. PCT/DE01/04879, filed on Dec. 21, 2001.

(30) Foreign Application Priority Data

Dec. 23, 2000 (DE) ..... 200 21 949 U

(51) Int. Cl.
*H05B 3/00* (2006.01)

(52) U.S. Cl. ..... 219/217; 219/527; 219/529; 219/541; 219/543

(58) Field of Classification Search ..... 219/543, 219/528, 529, 549, 212, 217
See application file for complete search history.

(56) References Cited

U.S. PATENT DOCUMENTS 3,768,156 A 10/1973 Caird et al.
5,229,582 A * 7/1993 Graham ..... 219/541
5,516,189 A * 5/1996 Ligeras ..... 297/180.11
6,172,344 B1 * 1/2001 Gordon et al. ..... 219/529
6,194,692 B1 * 2/2001 Oberle ..... 219/543
6,353,207 B1 * 3/2002 Burt ..... 219/217

FOREIGN PATENT DOCUMENTS

DE 2148191 4/1973

* cited by examiner

*Primary Examiner*—Robin O. Evans
*Assistant Examiner*—Vinod Patel
(74) *Attorney, Agent, or Firm*—Martin Fleit; Paul D. Bianco; Fleit Kain Gibbons Gutman Bongini & Bianco PL

(57) ABSTRACT

A surface heating system consists of a support and a heating layer that contains an electrically conductive plastic. The heating layer is formed by a flexible film. A heatable object made as such a surface heating system. A method for producing a surface heating system, where a heating layer containing an electrically conductive plastic bonded to a support, and where the heating layer is formed by initially applying an electrically conductive, especially a foam plastic material onto the support and then hardening the plastic material on the support. Alternatively, the method produces a surface heating system with a heating layer of an electrically conductive plastic is bonded to a support. The heating layer is produced from an electrically conductive, especially a foam plastic material, and then arranged on the support. Another alternative of the method consists of bonding a heating layer with an electrically conductive plastic to a support. A fabric is produced as the support. Contact terminals from power supply wires are woven into the fabric when it is made or afterwards, and then a heating layer is applied to the support and the contact terminals.

32 Claims, 7 Drawing Sheets

SURFACE HEATING SYSTEM AND METHOD FOR PRODUCING IT AND A HEATABLE OBJECT

RELATED APPLICATION

This application is a continuation of PCT International Application No. PCT/DE01/04879, filed Dec. 21, 2001, the contents of which are here incorporated by reference in their entirety.

BACKGROUND OF THE INVENTION

1. Field of the Invention

The invention relates to a novel surface heating system, a heatable object with the novel surface heating system and a method for producing the novel surface heating system. More particularly, this invention relates to a seat heating system, a heated seat and a method for producing it. Preferably, the invention additionally relates to a heating system for side panels and floor coverings, in particular in motor vehicles, side panels and floor coverings outfitted with such heating system in particular in motor vehicles and a method for producing them. Furthermore, this invention relates in particular to a mattress heating system, a heated mattress and a method for producing it.

2. Prior Art

Seat heating systems are known from practice, for example, for motor vehicles; these systems in the sense of the invention are a surface heating system and are formed by current-carrying metallic conductors as heating wires that are arranged between cushion layers. This necessitates not only a costly construction of an appropriately designed seat, but it also has disadvantages in particular in operation. For instance, because of the stronger heating of surrounding layers in the immediate vicinity of the heating wires there is a danger of overheating, which can lead to damage to the cushion layers and/or the heating wires and even cause a fire. Furthermore, the heat distribution over the area is not optimum, since the temperature is always higher in the region of the heating wires than at a distance from them. Also disadvantageous with this known style is the mechanical stress to which the heating wires are subjected when a passenger uses the seat, since the conducting wires can break because of this, which can lead to failure of operation and/or can have as a consequence another source of fire.

A composite heating element that provides a directed heat radiation and is formed of a plastic laminate with incorporation of a semiconducting layer is known from DT 26 16 771 A1. This laminate consists of a hard plastic laminate structure that is formed of at least one layer of a reinforced substrate base material and a resin coating on this material, a semiconducting carbon containing a pyropolymer, which is bonded to a heat resistant inorganic oxide support with large surface area, which is incorporated as a layer on at least one side of the layer of the substrate material, a heat reflecting layer incorporated on the substrate material in a position on one side of the pyropolymer, and power supply devices to spaced parts of the layer of conductive carbon-containing pyropolymer, and which produces electrical resistance heating in the laminate, which is reflected and radiated by the heat reflecting layer of the laminated element. Such heating panels are intended to be used as part of a wall of a living space or office.

With this prior art the incorporation of the semiconducting layer into the laminate can take place by mixing finely divided carbon-containing pyropolymer in the form of small particles or as powder with a suitable carrier or vehicle, which can be brushed, spread or otherwise applied to the surface of a resin coated glass cloth of paper, felt, cardboard and the like as laminate substrate or to a wood veneer that is used in the laminate panel. Instead of this, the finely divided carbon-containing pyropolymer can also be mixed with the resin or polymer material with which a particular reinforcing base material is to be impregnated or that is to be applied to this base material as a coating, where this base material provides at least one substrate material of the laminate. The resulting mixture is applied into or onto the substrate by immersion or coating, and the resulting coated substrate is subjected to a semi-hardening such that the semiconducting pyropolymer produces a uniform impregnation and coating over the resulting semi-hardened laminate sheet.

DE 33 16 182 A1 concerns the use of molded articles like films, or panels or three dimensionally shaped articles from the class of the pyrrole polymers that are complexed with anions, as electrical heating elements in particular for heating corroding liquids or gases. The molded articles can also be coated with organic plastics.

A polymer composite heating element is described in DE 35 24 631 A1 and has the form of a film, tube or rod. Such polymer composite heating elements can be used as heating elements as such or can be laminated with traditional plastic films in order to improve the strength of the material.

The use of electrically conductive thermoplastic polyurethanes and their preparation are known from DE 33 21 516 A1. The corresponding products are suitable, among other things, for the preparation of 1–2 mm thick films for surface heating elements.

Thus, heating elements with electrically conductive plastic are indeed known, but in all of the prior art there is no data or hints of how such heating elements are to be designed and produced in order to be able to use them in practice.

Surface heating systems that have a layer of electrically conductive plastics are illustrated in a number of other publications of the international patent classes H05B 3/36 and 3/84 using the outside mirrors of motor vehicles as examples. Essentially, films of electrically conductive plastics on solid supports are used in this case. The use of a film of electrically conductive plastics on the support structure of a vehicle seat, however, is not possible, since all the cushion layers lying on top, etc., would have to be heated for the heat to reach a sitting passenger, which would involve a great deal of energy.

In particular for sitting or reclining supports there are no known usable surface heating systems with electrically conductive plastics. However, simple, inexpensive and safe heating systems would be desired, for example, for vehicle seats or mattresses.

SUMMARY OF THE INVENTION

Therefore, one goal of this invention is to create a surface heating system with an electrically conductive plastic as well as an object using it with cost that is as low as possible.

This goal is achieved with a surface heating system, a heatable object and a method for producing a surface heating system as described hereinafter.

As other advantages, a good, simple and operationally safe design and good heat distribution are enabled with the invention.

In accordance with the invention a surface heating system with a support and a heating layer that contains an electrically conductive plastic is created, where the heating layer is formed by a flexible film and the support is flexible.

Such a surface heating system is further developed within the scope of this invention by the fact that the support is a layer, in particular a woven or nonwoven material, preferably a natural or synthetic fiber nonwoven material. Alternatively, the carrier can be a molded article of an elastic material, for example a seat cushion of a seat bottom or a seat back, or a mattress.

Preferably the heating layer contains polyurethane, one-component polyurethane, crosslinked one-component polyurethane, a PU foam, UV-resistant and/or hydrolyzable and/or vapor-permeable plastic material. However, other electrically conducting or conductive foaming and foam materials are also usable, where plastic materials are preferred. Alternatively or additionally, it is preferred that the electrically conductive plastic of the heating layer contain graphite, preferably in powder form.

It can be further provided in the surface heating system that contact terminals from power supply wires in the heating layer or between the carrier and the heating layer be in contact with the latter. Preferably, the contact terminals of the power supply wires are affixed to the heating layer by means of the heating layer itself or are stitched or glued to the heating layer and/or the support.

In addition, it is advantageous for the heating layer to be formed directly by spraying, rolling or spreading on the support. Alternatively, the heating layer can be glued, stitched or welded to the support or can be affixed to it in other ways.

Furthermore, it is advantageous to design a manually and/or electrically/electronically operable and/or automatic current control that can be connected to a power source and hooked up to the current conducting wires whose contact terminals are in contact with the heating layer.

In addition, through the invention a heatable object is created that contains a surface heating system in accordance with the above developments.

Within the scope of a preferred design the object is a seat bottom or a seat back or a cushion of furniture for sitting or reclining, especially a mattress, and the heating layer is anatomically matched to the thigh/buttocks regions or the back regions of a user. The latter is advantageously achieved by anatomically molding the heating layer in the plane of the seat bottom or the seat back or the cushion of sitting or reclining furniture, especially a mattress, by it being present or electrically conductive only in accordance with anatomical guidelines. Alternatively or additionally, the heating layer can have a thickness profile corresponding to anatomically matched heat release.

Another preferred design of the heatable object consists of an upholstered lining or paneling, especially for a vehicle. Such a heatable object can also be designed for different heat release over its area.

Generally, it can further be provided that the heating layer is profiled for different heat release over its area in its areal extent and/or in its thickness.

Finally, this invention also creates a method for producing a surface heating system, where a heating layer with electrically conductive plastic is bonded to a support. In accordance with the invention the heating layer is formed by first applying an electrically conductive, especially foaming or foam plastic material onto the support and then hardening the plastic material on the support. A preferable further development of the method consists of initially arranging contact terminals from power-supply wires on the side of the support on which the plastic material will be applied, before applying the electrically conductive, especially foaming or foam plastic material to the support.

It is provided in a method in accordance with the invention for production of a surface heating system, where the heating layer with an electrically conductive plastic is bonded to a support, the heating layer is made of an electrically conductive, especially a foaming or foam plastic material, and then arranged on the support. Preferably, after being arranged on the support, the heating layer can be bonded to the support so that it will not slip. This preferably takes place by stitching, gluing or welding the heating layer to the support.

Electrically conductive polyurethane is advantageously used as the plastic material, but the plastic material is not restricted to this.

The method can be developed further by the fact that the contact terminals from the power supply wire are attached to the heating layer and/or the support so that in the sandwich of support and heating layer they are in contact with the heating layer. For this the contact terminals from the power supply wires are preferably stitched or glued to the heating layer and/or the support.

Another further development of the method in accordance with the invention consists of the heating layer being profiled in its surface shape and/or thickness during or after its manufacture. This can take place in the manufacture of the heating layer directly on the support, for example by means of templates that determine the surface shape of the heating layer. If the heating layer is manufactured separately, i.e., not directly on the support, its shape can be produced, for example, by molding or by stamping. The thickness over the area of the heating layer can also be varied.

Preferred and advantageous further developments result from the dependent claims and their combinations and the overall content of the disclosure of this document and taking into account the knowledge of specialists and the prior art, in particular to the extent that it is presented in the introduction of this description.

For example, the electrically conductive plastic material of the heating layer can contain carbon or carbon particles in order to make available electrical conductivity. Otherwise, the material of the heating layer is such that it remains at least essentially hardened and otherwise shape stable and undamaged at or after an increase of temperature as a consequence of the heating effect. As already noted, polyurethane (PU) is preferably used for the electrically conductive plastic, but basically all of the other materials disclosed in the prior art indicated above insofar as they can be foamed, are also usable. Other material data and technical background are disclosed, for example, in the publications DE G 85 23 328.5, DE 298 08 842 U1, DE 197 11 522 A1 and DE 691 01 703 T2, whose contents are hereby fully incorporated by reference into these documents in order to avoid mere repetition.

BRIEF DESCRIPTION OF THE DRAWINGS

The invention is illustrated in more detail below by means of embodiment examples, which are represented in the drawings, in which.

DETAILED DESCRIPTION OF PREFERRED EMBODIMENTS OF THE INVENTION

The same reference numbers are used throughout for the same or equivalent parts in the following description of the invention using the embodiment examples. Even though not all details of the graphic representations are treated in the following description the individual characteristics and their relationships to the extent that they are represented in the figures easily follow for a specialist from the drawings.

Figure 1A:
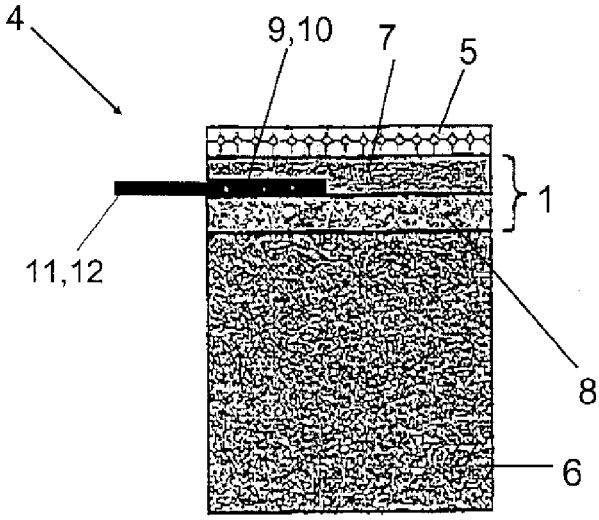
FIGS. 1*a* and *b* show schematically in a sectional or perspective view a first embodiment example of the invention in connection with a vehicle seat with seat heating, FIGS. 2*a* and *b* show schematically in a sectional or perspective partial view a vehicle seat with seat heating according to the prior art, FIGS. 3*a, b* and *c* show a second and a third embodiment example, a surface heating surface in accordance with the invention schematically in a perspective overview representation and a sectional view in connection with an interior trim panel of a vehicle, FIGS. 4*a* and *b* show schematically an interior trim panel cover of a vehicle as a fourth embodiment example of a surface heating system in a perspective overview drawing and a sectional view, FIGS. 5*a* and *b* show schematically a fifth embodiment example of an object with a surface heating system in a perspective overview representation and a sectional view in the form of a floor carpet for a vehicle.
Figure 1B:
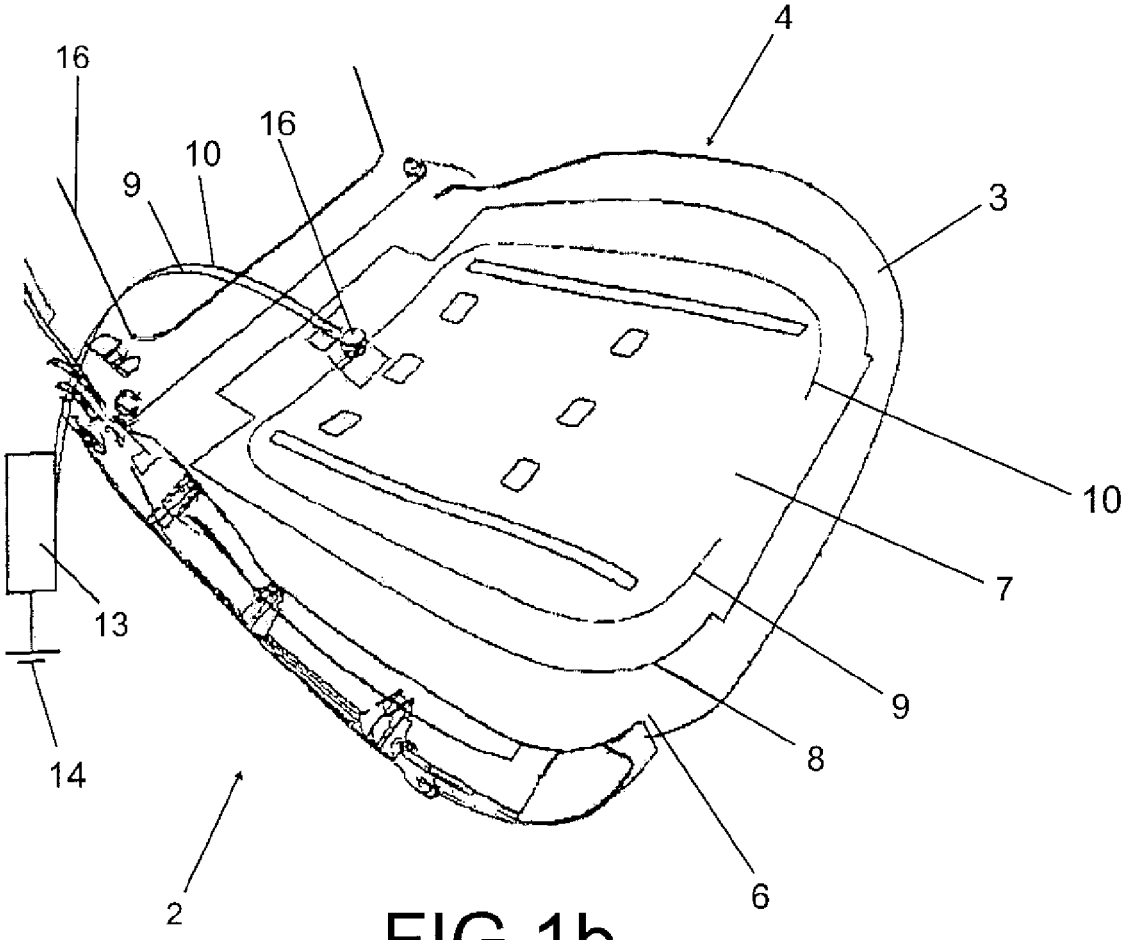

As a first embodiment example of a surface heating system 1 a vehicle seat 2 in which a seat heating system 4 is integrated into its seat bottom 3 is shown in FIGS. 1*a* and 1*b* in a sectional and perspective view.

The construction of the seat bottom 3 in the vicinity of the surface heating system 1 is shown in FIG. 1*a*, in which a cross section through the corresponding layers/components of the seat bottom 3 is shown. The surface of the seat bottom 3 is formed by a seat cover 5, which can consist of fabric, synthetic leather or leather or other suitable materials or combinations of materials. The shape of the seat bottom 3 is formed at least essentially by an elastic foam molded body 6. The components of the seat heating system 4 are arranged between the elastic foam molded body 6 and the seat cover 5.

The seat heating system 4 is formed by the surface heating system 1, which contains a heating layer 7 and a support 8. The support 8 is a flexible layer of a fiber nonwoven with natural and/or synthetic fibers. The heating layer 7 consists of a flexible electrically conductive plastic foam, for example electrically conductive polyurethane, from which a film or foil has been formed, so that a surface skin is produced. The film does not have any detectable pores, but in its microstructure can be close-celled or close-pored. In particular, the material is UV-resistant and/or hydrolyzable or vapor-permeable, in order to be used in accordance with the best use in furniture for sitting or reclining. In this way optimum conditioning of air through the base is ensured for the user.

The material for forming the film, for example UV resistant and hydrolyzable or vapor permeable crosslinked one-component polyurethane, is applied to the fiber nonwoven by spraying, for example, so that a so-called spray flush or spray skin is formed by this so-called spray flush method. Alternatively, the film could also be applied to the seat cover 5 or the elastic foam molded body 6 by this method. The material could also be sprayed into the foam mold for the elastic foam molded body 6 before introducing the foam material in order to bond with the foam material as it hardens. When producing the film by spraying, the thickness of the film can be precisely adjusted and optionally varied over its extent by means of the spray time, for example. Alternatively, the film can also be produced by rolling or spreading the corresponding material in particular on the support 7, but also it can be produced separately, and then bonded to the support 7, the seat cover 5 or the elastic foam molded body 6.

Between the heating layer 7 and the support 8 contact terminals 9 and 10 from power supply wires 11 or 12 are placed at the edge of the heating layer 7 so that they are in electrical contact with the heating layer 7 (see also FIG. 1*b*).

To produce the surface heating system 1 of the first embodiment example, flowable or flowing electrically conductive polyurethane material that contains, for example, carbon particles as illustrated above, can be applied to the fiber nonwoven material of the support 8 by rolling, spreading or spraying, after the contact terminals 9 and 10 of the power supply wires 11 and 12 have been appropriately positioned on the fiber nonwoven material of the support 8. After hardening the electrically conductive polyurethane foam it is flexible and in electrical contact with the contact terminals 9 and 10 of the power supply wires 11 and 12 and forms the heating layer 7. The contact terminals 9 and 10 of the power supply wires 11 and 12 can be held in position just by the bonding forces between the polyurethane foam and the fiber nonwoven. For further assurance that they are secured the contact terminals 9 and 10 of the power supply wires 11 and 12 can also be stitched to the sandwich (not shown). In this variation the electrically conductive PU layer of the heating layer 7 is at the same time also an adhesive or gluing layer.

Instead of forming the heating layer 7 directly on the fiber nonwoven of support 8, the heating layer 7 can also be produced separately and joined with the support 8 in a hardened, but flexible state. The connection between the heating layer 7 and support 8 takes place, for example, by gluing, stitching or welding, in each case according to what mode of processing can be carried in dependence on the materials that are used. The contact terminals 9 and 10 of the power supply wires 1 1 and 12 do not necessarily have to lie between the support 8 and the heating layer 7, but rather can also be applied to the side of the heating layer 7 turned toward the support 8 in order to obtain electrical contact.

The fiber nonwoven of the support 8 can also initially be a ribbon material on which the heating layer is formed over its complete surface or in correspondence with the geometry necessary for the seat bottom 3, or the pre-made heating layer 7 can also be laid on it as ribbon material or as parts molded in correspondence with the geometry necessary for the seat bottom 3 and then bonded to it. Then the desired individual pieces in correspondence with the geometry necessary for the seat bottom 3 can be produced, for example, by stamping. However, it is also possible for the fiber nonwoven first to be made in the geometry necessary for the seat bottom 3 and to form the heating layer 7 on it, which can also be pre-made in correspondence with the geometry necessary for the seat bottom 3. The contact terminals 9 and 10 of the power supply wires 11 and 12 can, in making the sandwich of support 8 and heating layer 7 in each case as suitable, be laid between them or arranged on the at least assembled sandwich so that they can be suitably secured.

In FIG. 1*b* the first embodiment example of the surface heating system 1 is illustrated further in a schematic perspective view in which the seat cover 5 is omitted. Here the layout of the contact terminals 9 and 10 of the power supply wires 11 and 12 can readily be seen. In addition a power control unit 13 and a power source 14 for control and operation of the surface heating unit 1 are also shown schematically. The power control unit 13 can be manually and/or electrically/electronically and/or automatically operable. In practice the power control unit 13 is the usual control of the temperature of the passenger compartment or a part thereof or a separate control. The power supply wires 11 and 12 are connected to the power control 13 and more or less end at their contact terminals 9 and 10. In front of the contact terminals 9 and 10 there can be, for example, a functioning unit 15 on the power supply wires 1 1 and 12, which can contain, for example, a special seat occupancy sensor, a heat sensor or temperature gauge, a distributor, etc.

The support 8 could be formed of other materials and structures instead of a nonwoven material, for example a woven material. The support 8 however, could also be a molded article, for instance the elastic foam molded article 6 itself of the first embodiment example in accordance with FIGS. 1*a* and 1*b*.

Suitable materials for the heating layer, i.e., the electrically conductive foam material, are specified in the supporting documents, especially with regard to their physical properties, and are otherwise well known to the specialists, and are also indicated, for example, in the prior art that is cited in the documents at hand, so that there is no need to go into this subject in more detail, but rather all suitable materials, especially from those cited in the documents at hand or the cited older publications are hereby incorporated herein by reference.

Although it is not illustrated above and also not shown in FIG. 1*b*, the seat back that is only partly visible in FIG. 1*b* can also be outfitted with a surface heating system 1. Furthermore, all similar objects without restriction, especially mattresses or other cushions, can be outfitted with a surface heating system in accordance with the invention. A use of the invention in side panels and floor coverings in particular in vehicles, is preferred.

Figure 2A:
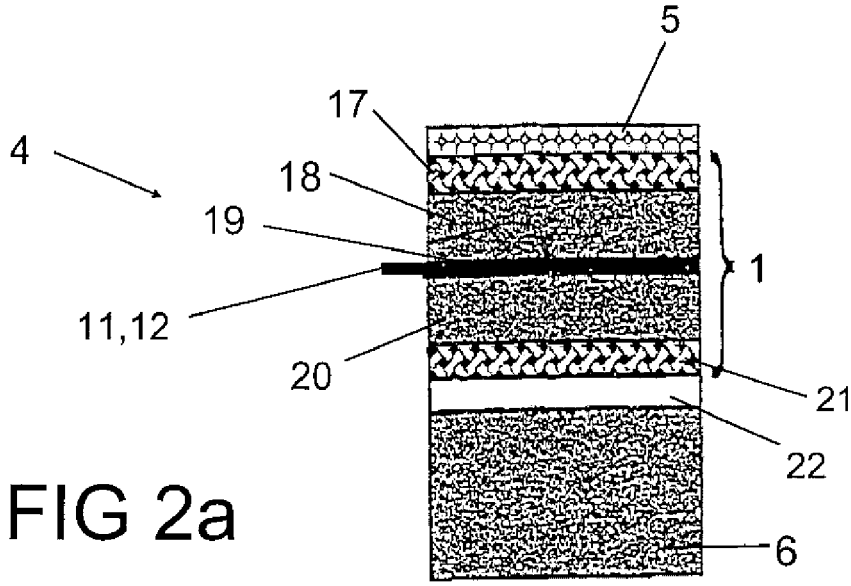
Figure 2B:
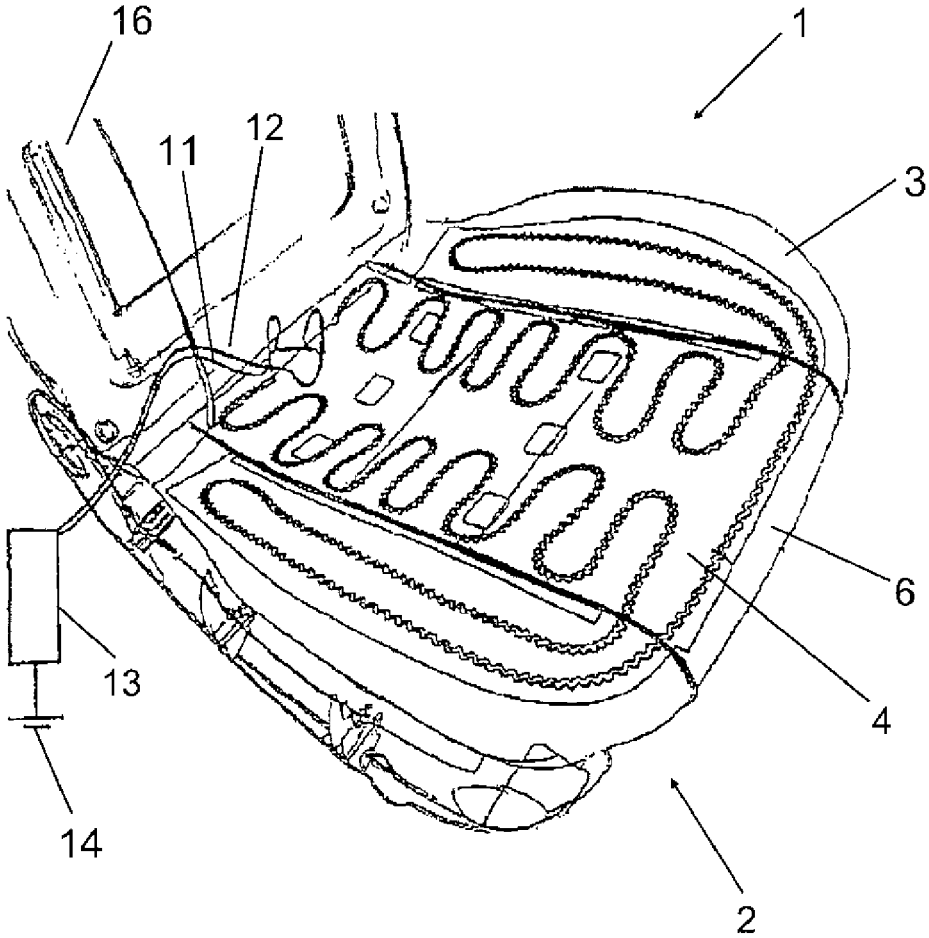

FIGS. 2*a* and 2*b* show representations by analogy with FIGS. 1*a* and 1*b* simply to illustrate the differences of this invention to the prior art. This known surface heating system 1 in the form of a seat heating system 4 for a vehicular seat has, in the usual way, the seat cover 5 and an elastic foam molded body 6, between which the surface heating system 1 is situated.

In the prior art, the surface heating system 1, as FIGS. 2*a* and 2*b* illustrate, contains, starting from the seat cover 5, an upper fabric layer 17, an upper foam layer 18, a heating wire layer 19, a lower foam layer 20 and a lower fabric layer 21, which as a prepared sandwich are bonded to the foam molded body 6 that forms the actual seat cushion so that they will not slip using a double sided adhesive strip 22.

In the production of this surface heating surface in accordance with the prior art the fabric layers 17 and 21 are first bonded to the immediately adjacent foam layers 18 or 20 in a flame lamination process.

FIGS. 3*a*, 3*b* and 3*c*, 4*a* and 4*b* and 5*a* and 5*b* present further embodiment examples of heating devices for vehicles.

Figure 3A:
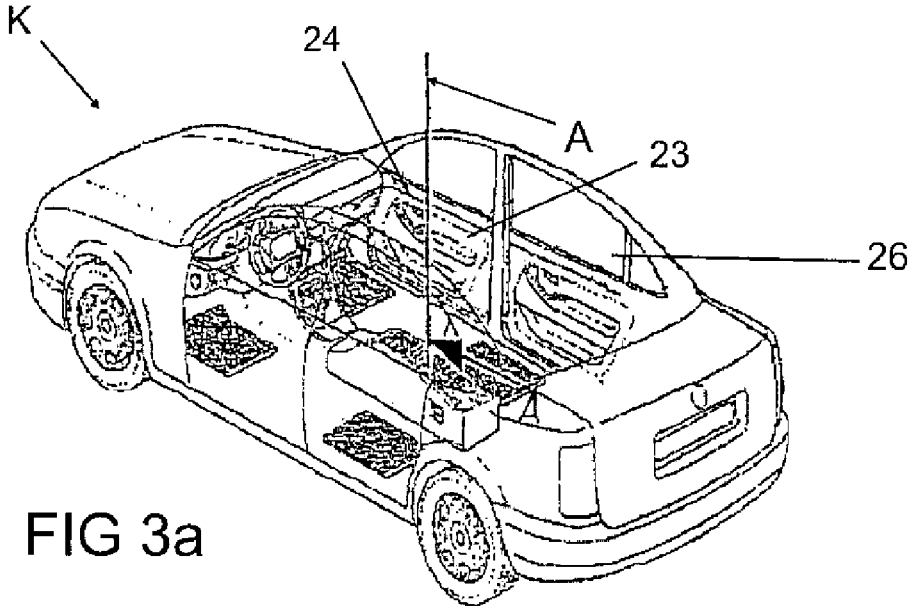
Figure 3B:
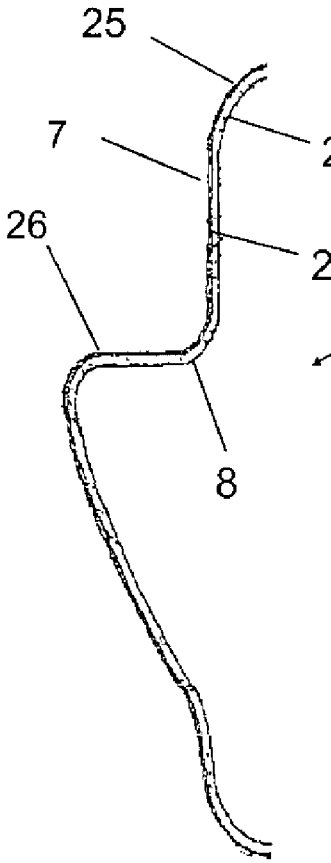

In FIG. 3*a* a vehicle K is shown in a cutaway view, in which a cutting plane A through an interior panel 23 of a car door 24 is shown. The schematic sectional view of the interior panel 23 in cutting plane A in accordance with the arrows shown in FIG. 3*a* is shown in FIG. 3*b* as a second embodiment example of a heatable object with a surface heating system 2. This interior panel 23 contains as support 8 a support layer 24, on which the heating layer 7 with electrically conductive plastic is applied by means of an adhesive agent 25. Since the visible surface of the interior panel 23 is formed by the heating layer 7 with electrically conductive plastic, the free visible side 26 of the heating layer 7 with electrically conductive plastic can be provided with a decoration (not visible), i.e., with a synthetic leather like appearance, in order to achieve a pleasant appearance for the interior panel 23.

Figure 3C:
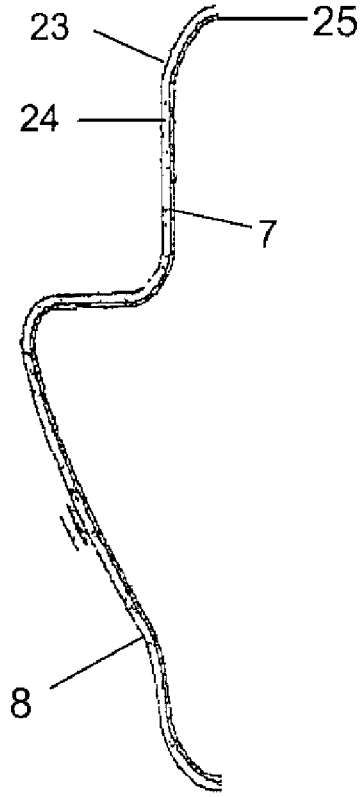

Alternatively to this embodiment example, in a variation thereof, which is shown in a cross section in FIG. 3*c*, the heating layer 7 with electrically conductive plastic can be applied to the side of the support layer 24 that is turned toward the inside 26 of the vehicle K using adhesive 25. In such a case either the support layer 24 itself can be provided on its visible side with a decoration (not shown) or a decoration 27 (only partly suggested for the sake of better clarity) can be applied to the visible side of the support layer 24.

The principle of the two embodiment examples just described can be extended to the entire passenger compartment 26 of the vehicle K, especially to the extent that the corresponding parts are upholstered. For example, vehicle seats for realization or support of seat heating, a roof lining, a rear shelf, column liners, consoles, a steering wheel, carpet material, air channels, especially within air channels for preheating cold air, etc., can be used as heatable objects with heating devices that contain a heating layer 7 with an electrically conductive plastic, to improve the interior climate in a vehicle. In this way it is not only possible to make the conventional heating plants smaller, but also to achieve faster and more uniformly distributed or achieved heating of the entire interior space 26 of a vehicle K. Other specific embodiment examples of this are illustrated in FIGS. 4*a* and 4*b* and 5*a* and 5*b*.

Figure 4A:
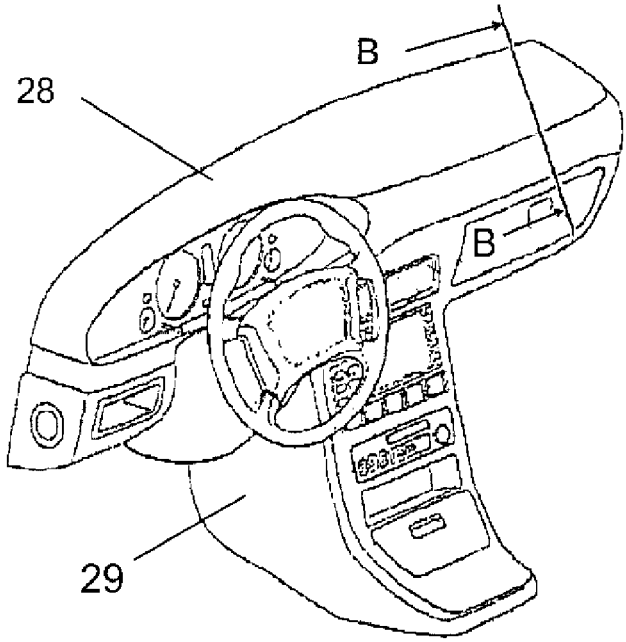
Figure 4B:
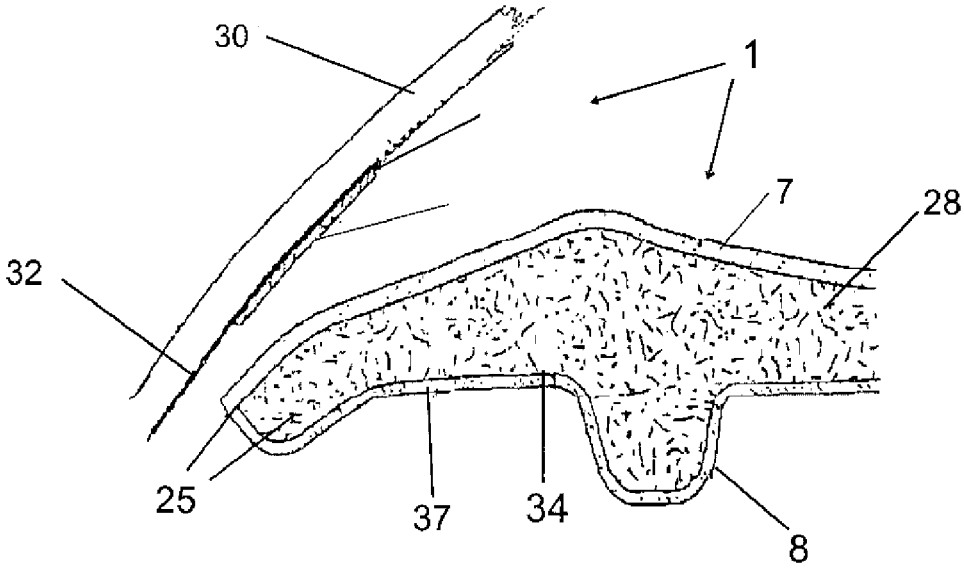

In a perspective of a instrument panel 28 and console 29 FIG. 4*a* shows the position of a cutting plane B, where the viewing direction onto the cutting plane is illustrated by arrows in the representation in FIG. 4*b*. FIG. 4*b* is the section through the instrument panel 28 in cutting plane B, where a part of the adjacent windshield 30 of the correspondingly outfitted vehicle K is also shown in the cross section. The heating layer 7 with electrically conductive plastic forms the plastic skin with which the instrument panel 28 is covered and that forms the surface of the latter. By means of an adhesive agent 25, which in this fourth embodiment example is formed by a filling compound like foam, etc., the heating layer with electrically conductive plastic is bonded to a support layer 24 in the capacity of carrier 8 that serves as spacer 31. The heating layer 7 with electrically conductive plastic forms a skin with incorporated conductive material. Alternatively, in this embodiment example the heating layer 7 with electrically conductive plastic could also be covered by a decorative layer (not shown), for example analogous to the variations shown in FIG. 3*c*.

In FIG. 4*b* a windshield 30 is shown in part in cross section as a further embodiment example of an object with a surface heating system 1. This windshield 30 is provided with a black ceramic layer 32 in the region where it begins which can be applied, for example, by silk screen printing. In addition, it is provided that in the region of the ceramic layer 32 a heating layer 7 with electrically conductive plastic is affixed to the windshield 30 directly or by means of an adhesive agent 25, for example a glue. Through this embodiment it is possible, for example, to realize an ongoing additional and/or separate heating of the windshield 30 in order to prevent fogging, for defogging or for deicing. In addition, such a surface heating system 1 can be provided in particular in the region of the resting position of the windshield wipers (not shown) in order to realize in this case an additional and/or separating of the windshield 30 so that damage to fast frozen windshield wiper blades (not shown) can be avoided when the windshield wipers (not shown) are put into operation.

If the heating layer 7 with electrically conductive plastic consists of transparent material, then a transparent region of a window pane, for example a windshield 30, can be provided with a corresponding surface heating system 1. In this way fogging of a window pane outfitted in this way can be removed or avoided and even icing up can be thawed. The heat conductors currently used with rear windows, for example (not shown) could then be omitted or made smaller.

Figure 5A:
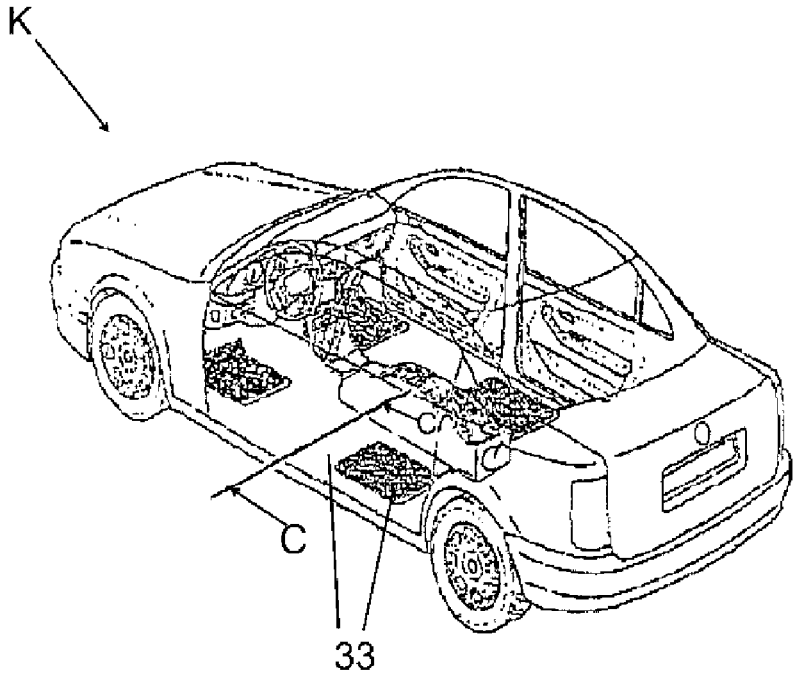
Figure 5B:
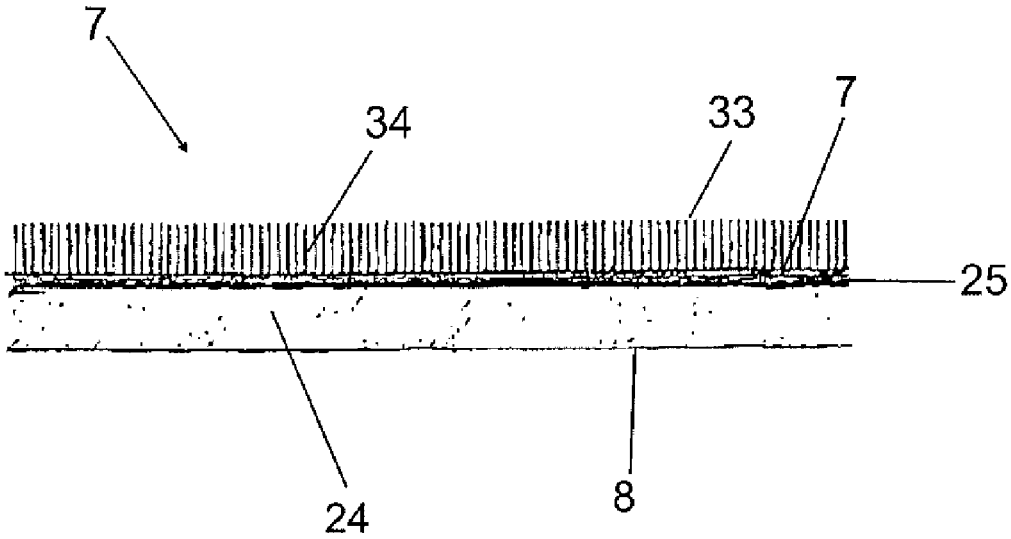

As another variation for interior space heating of a vehicle K FIGS. 5*a* and 5*b* show the design of carpet material 33 with a surface heating system 1. In this sixth embodiment example, which is illustrated in FIG. 5*b* in a partial cross section, which should be viewed in accordance with the direction of the arrow toward cutting plane C in FIG. 5*a*, the construction of such a carpet material 33 is shown. Here the heating layer 7 with electrically conductive plastic is bonded by means of adhesive 25 to a lower support layer 24 as support 8.

Bristles, loops or generally fibers/threads 34 that form the upper side of the carpet material 33 can in this case be affixed either to the support layer 24 or can pass through the heating layer 7 with electrically conductive plastic, can be affixed only to the layer with electrically conductive plastic, or can originate from a special ply (not shown) which is bonded by means of adhesive 25 to the heating layer 7 with electrically conductive plastic. In the latter case the support layer 24 can also be omitted and the support 8 can be formed by such a separate ply (not shown).

It is also within the scope of this invention if the heating layer 7 with electrically conductive plastic is formed directly by the support layer 24, or if the heating layer 7 with electrically conductive plastic is affixed to the support layer 24 by means of the bristles, loops, fibers or threads 34 that form the upper side of the carpet material 33. Additionally it is possible to affix the heating layer 7 with electrically conductive plastic to the underside of the support layer 24 using an adhesive 25, so that the traditional carpet material 33 can otherwise be produced in the usual way and can be provided with the surface heating system 1 subsequently. It is also possible to outfit carpet material 33 that is already present with a surface heating system 1.

As already noted, it is possible by connecting the heating layer 7 with electrically conductive plastic material to a power source (not shown) to achieve a desired heating or warming effect with the correspondingly heated objects. Since the electrical resistance of the heating layer 7 is constant, the heating temperature can be determined or regulated via the supplied electrical power. In an advantageous way there is in this case the possibility of using both direct, and alternating current, in particular without producing electrosmog. Since the heat that is produced in this way is also exclusively radiant heat, a certain temperature and heating comfort results.

If natural raw materials such as wood fiber, sisal, banana stalk material, coconut fiber, etc. are used, odor formation in wet weather as well as bacterial attack often present serious problems. If, as with the described embodiment examples, the interior panel parts are designed to be heatable, it is possible to additionally achieve an avoidance of such odor formation and bacterial attack in the combination of effect with the pure warming effect.

Other specific examples for heatable objects with a surface heating system 1 as in this invention are, for example, a diesel tank of plastic, where paraffining of diesel fuel at low outside temperatures can be prevented by being able to maintain a minimum temperature, an oil bath via which motor oil can be preheated for better and more efficient operation of the engine, an entire engine compartment, which enables preheating of the engine, as well as, for example, a storage space both in passenger cars as well as in trucks. Surface heating systems 1 can be advantageously used in vehicle interiors as well as in vehicle exterior regions.

This invention, however, is not limited to use in the field of vehicles. All of said embodiment examples and variations as well as analogous applications can be used, for example, with other vehicles such as bicycles, in the railroad, on ships and planes.

As already noted, numerous other areas of use of this invention are possible, for instance in the case of motorcycles and mopeds the seats and operating elements can be outfitted with the corresponding surface heating systems. Other application possibilities, for example, lie in the household (coating of plastic wallpapers, wooden ceilings, wooden floors, carpets, tiles, jackets for heating and water pipes, floor heating systems), for clothing, etc. (shoes, boots, ski boots, work clothing, protective clothing, gloves, electric blankets, warming blankets, for example in the hospital field, warming containers), in sports and recreation (sports fields with artificial turf, tent floors, sleeping surfaces in tents), as well as in the military (for instance preheating of vehicles for better engine start in winter).

In particular, aliphatic and aromatic polyurethanes are mentioned here only as preferred electrically conductive plastic materials or plastic materials that can be made electrically conductive.

With regard to the manufacture of a surface heating system or an object made with such a system in accordance with the invention it is preferable if the layer with or of electrically conductive plastic is made in a spray or immersion process or by roller application. A corresponding coating is preferably provided with a method for producing a heating device or an object with such a device. The invention in this way enables in particular a matching or choice of the coating method to the geometry of the form to be coated and/or the number of pieces to be produced.

With the exemplary and comparable embodiments treated above the layer thickness of the electrically conducting layer is preferably between about 0.05 mm and approximately 0.3 mm. If the electrically conducting layer is also intended to satisfy a function as a visible surface, it is preferable if the thickness is thicker. In particular, it is also within the scope of this invention to adjust the layer thickness in dependence on the requirement or requirement profile to the surface heating system or the object which can easily be found out by analysis or tests. For example, a layer thickness of 1.2 mm can be called for in the case of a surface layer with additional function such as a vehicle interior paneling.

As already indicated, particularly preferred specifications for the plastic material of heating layer 7 are that it contains or consists of polyurethane, namely preferably a crosslinked and/or one-component polyurethane, which is in particular UV resistant and hydrolyzable or vapor permeable.

A variation in which a seat occupancy recognition system that is in particular dependent on weight is realized with the arrangement of the surface heating system 1 at the same time as seat heating is a particular specialty of this invention. Such seat occupancy recognition systems must today be specially realized in order to carry out, for example, triggering of an air bag in the case of an accident only if an occupant is sifting on a corresponding seat. Through the combined realization of the surface heating system 1 in accordance with this invention with the simultaneous function of seat occupancy recognition, which can additionally provide weight-dependent data, in order to control appropriately the type and strength of an air bag triggering, not only will construction costs be saved, but also volume and weight in and on the vehicle, namely at places where it is not necessary for the stability and safety of the vehicle.

Figure 6:
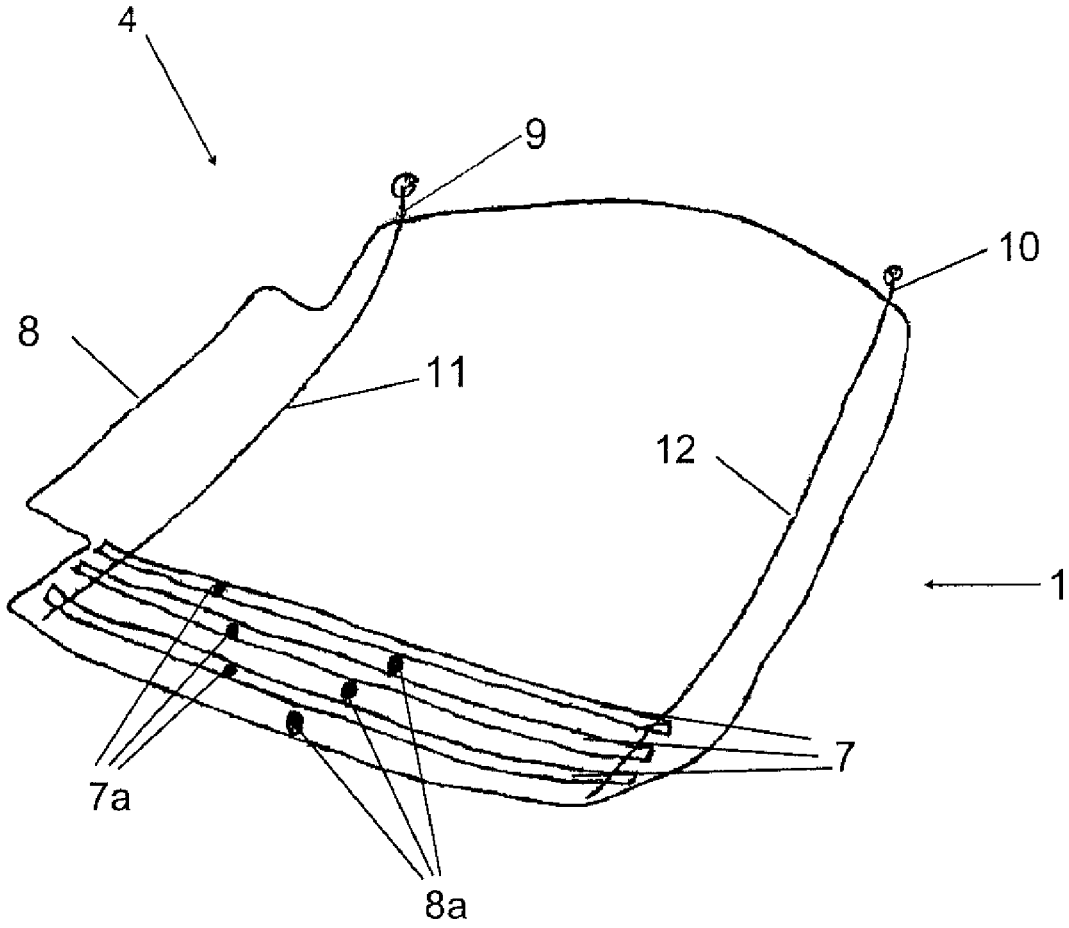
FIG. 6 shows schematically as a sixth embodiment example of the invention a vehicle seat with seat heating in a perspective partial view and FIG. 7 shows in section another embodiment.

The surface heating system 1 contains in particular a striped heating layer 7 with electrically conductive plastic, as is illustrated schematically in FIG. 6, for example. As shown, parallel strips or stripes 7*a* are coated onto the support or base 8 whereas the intermediate regions 8*a* are uncoated. The strips 7*a* are shown only at the lower part of the Figure, but would extend over the entire base 8 to form a heating network. Supply wires 11 and 12 connect to the strips 7*a* at their opposite edges. Contact terminals 9 and 10 couple the wires 1 1 and 12 to a base network and power supply. As for the rest, all the characteristics in accordance with the design in accordance with the embodiment example given in FIGS. 1*a* and 1*b* are combinable and understandable for any specialist, so that the corresponding descriptions are omitted here.

Indeed, not specially shown in the drawing, but nevertheless an important use of this invention, is a mattress with a surface heating surface in accordance with the invention. A mattress designed in this way has the advantage over the prior art, in which a so-called electric blanket with metallic resistance heating wires is used, that the operating safety is at least considerably improved. A fire cannot result with a surface heating system in accordance with this invention. In the case of damage to the heating layer, which can also be designed to be in strips, no sparks arise as is the case with metallic conductors.

Likewise, it was already explained above, especially in connection with the first embodiment example, that the heating layer 7 is a film or foil. Preferably, it is a varnish-like polyurethane layer or a polyurethane varnish layer with said physical properties, in particular an enrichment with carbon dust to achieve electrical conductivity. In addition, it is preferred if it is a one-component polyurethane material and/or is provided with an enrichment with carbon dust for electrical conductivity.

A preferred thickness of the heating layer 7 is from about 0.3 mm up to about 0.5 mm.

Instead of the spray application of the electrically conducting plastic material onto the support that was already discussed in detail above, it is also possible to use a roller method, for example. In this case liquid polyurethane, for example, is applied to a roller and then applied to a substrate, for example the support or an external substrate. The spacing of the roller surface from the substrate determines the thickness of the heating layer. After solidification or hardening of the polyurethane, again a varnish film with the desired properties is obtained, where measures to shape the film, including cutting, can be carried out during the roller application or subsequently, as already explained above.

If the heating layer is optionally produced on the support by a suitable process, then subsequently the heating layer by itself or already together with the support can optionally be bonded to a support or, for example, a molded article or a covering by stitching, gluing, adhesive strips, etc., as was already discussed above.

The surface heating system can be operated with alternating or direct current, with the response behavior being better than when direct current is used.

Other advantages of the surface heating system in accordance with the invention, besides the cost advantage, over earlier systems with metal heating wires lie in the uniform heating behavior and lower power consumption compared to the traditional seat heating systems with metallic heating wires, as was shown by a series of tests.

A commercial seat heating system from the Bauerhin company (model S4300) was compared with a surface heating system in accordance with the invention having a heating mat of electrically conductive plastic. The seat bottoms and seat backs were each separately controllable. The heating mat was fastened to the seat over the head rest supports and fastened at the edge by an adhesive strip.

The measurements were intended to provide information about the heating behavior and power consumption of the two seat heating systems. Specifically the goal of the test was to determine the heat-up times for the two designs along with the pertinent power consumption. For this a constant voltage of 12 V was applied to the connection terminals of the two heating systems. The consumed current is measured via a current measurement device integrated into the power supply. The temperature and current are measured at intervals of 1 min. Comparison between the two heating systems is done via the values measured at the seat.

| Heating mat of Conductive plastic | | | System S4300 of the Bauerhin Co. | |
|---|---|---|---|---|
| Temperature In ° C. | Current in Amps | Time in minutes | Temperature in ° C. | Current in Amps |
| 21.4 | 7.4 | 0 | 22.4 | 0.0 |
| 26.0 | 7.1 | 1 | 24.1 | 7.8 |
| 30.4 | 6.8 | 2 | 26.9 | 7.7 |
| 36.0 | 6.7 | 3 | 28.8 | 7.7 |
| 37.0 | 6.6 | 4 | 30.3 | 7.6 |
| 7.0 | 6.6 | 5 | 31.1 | 7.6 |
| 39.1 | 6.5 | 6 | 31.3 | 7.6 |
| 40.3 | 6.5 | 7 | 32.5 | 7.6 |
| 41.4 | 6.5 | 8 | 33.0 | 7.6 |
| 42.1 | 6.5 | 9 | 34.0 | 7.6 |
| 42.6 | 6.5 | 10 | 34.4 | 7.9 |
| 43.1 | 6.5 | 11 | 34.7 | 7.6 |
| 43.7 | 6.5 | 12 | 35.0 | 7.7 |
| 44.4 | 6.5 | 13 | 35.4 | 8.0 |
| 44.7 | 6.5 | 14 | 35.8 | 8.0 |
| 45.1 | 6.5 | 15 | 35.6 | 7.6 |
| 46.0 | 6.4 | 25 | 36.0 | 7.6 |
| 48.1 | 6.6 | 50 | 36.1 | 7.7 |

The temperature measurement point was approximately in the middle of the seating area for the heating mat of the surface heating system in accordance with the invention with a heating layer having electrically conductive plastic. With the traditional design using metallic heating wires the temperature measurement point was 0.5 cm away from a heating wire. The temperature at the heating wire itself after 25 min was 50° C. This temperature is necessary to achieve a surface effect. However, considerable problems are linked to this in practice, for example, the wire can burn through or the seat cover can ignite at temperatures that are too high. These problems are eliminated with the heating surface system in accordance with the invention.

Another not inconsiderable disadvantage with the traditional seat heating system is the possibly pointwise high temperature at the position of the male genital region, which can lead to disruption of fertility. The surface heating system in accordance with the invention fundamentally does not generate any over-high temperatures, since it can in fact release heat over the entire area, and moreover can be left off of the corresponding site or decreased there.

Other tests showed that the heating behavior of the seat and back parts are approximately the same.

The superiority of the new surface heating system in accordance with the invention over the prior design with metal conducting wires shows up really clearly from the test results. The surface heating system with the heating layer having electrically conductive plastic heats up faster and consumes less power than the traditional seat heating.

Thus, a surface heating system is created through the invention that can release heat over the entire area, which can be ensured better with a design having the heating layer consisting of the individual spaced strips mentioned above better than with the prior art, can be reversibly matched to a pressure load for a substrate, for example a foam seat cushion, and does not lead to thawing of moisture or air in use.

Indeed, this invention, therefore, is not limited to the heating of upholstered objects, rather the uses of the surface heating system in accordance with the invention as heating for seating or mattresses, or in a seat, especially a vehicle seat, a mattress, are especially preferred and advantageous, though separate protection directed to this is justified. The flexibility of the heating layer is of particular importance.

Figure 7:
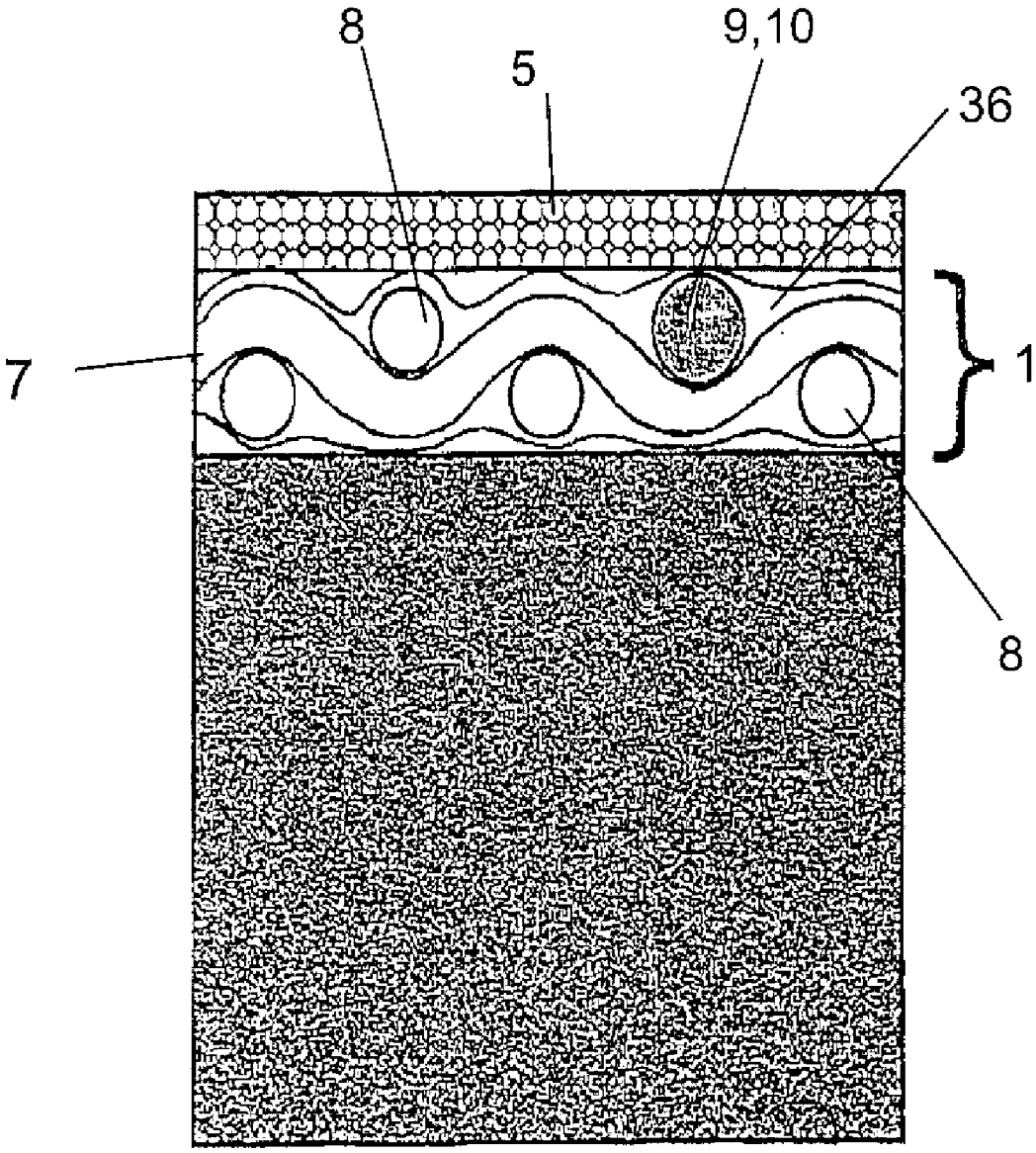

Below one more preferred embodiment of the invention is explained in more detail by means of the embodiment example shown in FIG. 7 with reference to this drawing.

By analogy with FIG. 1 a part of a surface heating system 1 that can be used as seat heating 4 as in FIG. 2 is shown in cross section. This surface heating system 1 contains as support 8 a polyester or polyamide fabric with, for example, a mesh size of about 5 mm, i.e., a mesh or lattice, in which the adjacent quasi parallel material strands have a spacing of about 5 mm. The structure of the support 8 and its material is not limited to these data, but rather can be easily chosen by the specialist in correspondence with the particular mechanical requirements, i.e., other materials or material combinations as well as thicknesses of the material strands and other mesh sizes can also be chosen in dependence on application.

The support 8 is provided by spraying, immersion, rolling or other means with a layer of electrically conductive plastic 36 in accordance with the invention, as well as in the other documents. This means that the material strands of the polyester or polyamide fabric are completely surrounded or jacketed with the electrically conductive plastic 36 which thus forms the heating layer 7.

As a further characteristic conductive silver or copper wires are woven into the polyester or polyamide fabric, i.e., into support 8, at a spacing of 5–10 cm, for example, and these wires, by analogy with the first embodiment example as in FIG. 1, form the contact terminals 9 and 10 of the power supply wires 11 and 12. Since the silver or copper wires, i.e., the contact terminals 9 and 10, also are surrounded or jacketed with the electrically conductive plastic 36 by the spraying, immersion, rolling or other application of the layer of electrically conductive plastic in accordance with the invention, optimum electrical contact between them is optimally provided. The spacing of the silver or copper wires as contact terminals 9 and 10 of the power supply wires 1 1 and 12 is not limited to the range of values that are indicated, but rather can easily be selected by the specialist in correspondence with the particular mechanical and electrical requirements, i.e., other materials or material combinations as well as thicknesses of the contact terminals 9 and 10 and other spacings can also be chosen in dependence on application.

Preferably, but not as a matter of restriction, the contact terminals 9 and 10 in the case that the surface heating system 1 is a seat heat system 4, run in particular in a direction of about 90° to the direction of driving of a vehicle (not shown). Basically the contact terminals 9 and 10 in the form of silver or copper wires can, however, run in any lengthwise or transverse direction.

A particularly preferred material composition for the heating layer 7, i.e., for the electrically conductive plastic, is:

300 g rubber, which is used in the manufacture as granulate, in this case as very fine dust, 300 g tetrahydrofuran, 165 g graphite, and 300 g of a polyurethane, such as, and advantageously, 4715 Lupranol from the BASF company.

This yields a total amount of 1065 g. The fractions can correspondingly be calculated for other amounts.

Preferred fractions for the individual components of the material composition for the heating layer 7, i.e., for the electrically conductive plastic, are:

about 20–35%, preferably approximately 25–30%, especially preferably about 28% of a rubber or especially a mechanically and/or electrically equivalent or similarly acting material, about 20–35%, preferably approximately 25–30%, especially preferably about 28% tetrahydrofuran or especially a mechanically and/or electrically equivalent or similarly acting material, about 5–25%, preferably approximately 10–20%, especially preferably about 15% graphite or especially a mechanically and/or electrically equivalent or similarly acting material, and about 20–35%, preferably approximately 25–30%, especially preferably about 28% of a polyurethane, for example and advantageously 4715 Lupranol from the BASF company, or an especially mechanically and/or electrically equivalently or similarly acting material.

Another embodiment possibility of the invention is illustrated below. By measuring the change of power consumption of the heating layer 7 a seat occupancy recognition system can be realized with particular simplicity and advantageous. This seat occupancy recognition system functions both to establish if the seat is occupied at all and also to establish in particular the weight of the passenger who is sitting on the seat. This aspect of this invention is on the one hand particularly advantageous in combination with the surface heating and on the other hand, can also be used separately from it as a seat occupancy recognition system by itself with a structure and characteristics analogous to those disclosed for the surface heating surface system in the overall documents at hand; this seat occupancy recognition system is deserving of protection by itself and optionally can be a component of separate applications for protective rights and of protective rights.

This invention was explained above in more detail by means of embodiment examples, to which the invention is, however, not limited. All modifications, combinations, variations and substitutions of the characteristics illustrated above and reproduced in the drawings are within the range of the special knowledge of this invention. In particular all design possibilities that lie within the scope of the pertinent claims belong to the invention. In particular, the indicated uses of the heating devices in accordance with the invention are disclosed and optionally are to be seen as separately deserving of protection.

What is claimed is:

1. A surface heating system comprising:

an air permeable support including a flexible fabric mesh layer having a plurality of fibers strands;

a flexible conductive heating layer, including an electrically conductive plastic affixed to the flexible layer of fibers of the air permeable support, wherein the electrically conductive plastic contains:

about 20–35% of a rubber;

about 20–35% tetrahydrofuran;

about 5–25% graphite; and about 20–35% of a polyurethane; and a power supply wire including a contact terminal in electrical connection with the flexible conductive heating layer, wherein the contact terminal is positioned between the air permeable support and flexible conductive heating layer.

2. A surface heating system as set forth in claim 1, wherein the air permeable support is formed from a woven or nonwoven fabric.

3. A surface heating system as set forth in claim 2, wherein the air permeable support is made of a nonwoven fiber material.

4. A surface heating system as set forth in claim 1, wherein the flexible conductive heating layer includes polyurethane, one-component polyurethane, cross linked one-component polyurethane, or PU foam.

5. A surface heating system as set forth in claim 1, wherein the flexible conductive heating layer includes a UV-resistant, hydrolysable, and vapor-permeable plastic material.

6. A surface heating system as set forth in claim 1, wherein the electrically conductive plastic includes graphite.

7. A surface heating system as set forth in claim 1, further comprising a plurality of power supply wires each including contact terminals in electrical connection with the flexible conductive heating layer.

8. A surface heating system as set forth in claim 7, wherein the contact terminals are positioned between the air permeable support and flexible conductive heating layer.

9. A surface heating system as set forth in claim 7, wherein the contact terminals are positioned in the flexible conductive heating layer.

10. A surface heating system as set forth in claim 7, wherein the contact terminals are affixed to the flexible conductive heating layer by stitching or gluing.

11. A surface heating system as set forth in claim 7, further comprising a power control unit operably connected to the plurality of power supply wires.

12. A surface heating system as set forth in claim 7, wherein the air permeable support is formed by a woven fabric and the contact terminals are positioned within the woven fabric.

13. A surface heating system as set forth in claim 1, wherein the flexible conductive heating layer is formed directly on the air permeable support by spraying, rolling, or spreading.

14. A surface heating system as set forth in claim 1, wherein the air permeable support is molded.

15. A surface heating system as set forth in claim 14, wherein the air permeable support is molded to form portion of a mattress, a seat cushion, or a seat back.

16. A surface heating system as set forth in claim 1, wherein the electrically conductive plastic contains:

about 30–70% graphite; and about 30–70% aqueous polyurethane binder.

17. A surface heating system as set forth in claim 16, wherein the electrically conductive plastic contains rubber.

18. A surface heating system as set forth in claim 1, wherein the flexible conductive heating layer includes carbon fibers.

19. A surface heating system as set forth in claim 18, wherein the flexible conductive heating layer consists of carbon fibers.

20. A beatable object, comprising a surface heating system as defined in claim 1.

21. A heatable object as set forth in claim 20, wherein the heatable object is a car seat.

22. A beatable object as set forth in claim 21, wherein the heating layer is anatomically matched to a contacting portion of a user.

23. A beatable object as set forth in claim 20, wherein the heatable object further comprises a cover covering the surface heating system.

24. A heatable object as set forth in claim 23, wherein the cover is a material selected from the group consisting of a fabric, leather, synthetic material, and combinations thereof.

25. A surface heating system as set forth in claim 1, wherein the air permeable support is formed from a nonwoven fabric and the electrically conductive plastic is a foam.

26. A surface heating system as set forth in claim 25, wherein contact terminals are located between the support and the heating layer.

27. A surface heating system comprising:

an air permeable support including a flexible fabric mesh layer having a plurality of fiber strands;

a flexible conductive heating layer, including an electrically conductive plastic affixed to and at least partially surrounding each of the plurality of fiber strands, wherein the electrically conductive plastic contains:

about 20–35% of a rubber;

about 20–35% tetrahydrofuran;

about 5–25% graphite; and about 20–35% of a polyurethane; and a power supply including wire including a contact terminal, the contact terminal forming a plurality of electrical connections with the flexible conductive heating layer.

28. A surface heating material as set forth in claim 27 wherein the plurality of fiber strands are incorporated within the flexible conductive heating layer.

29. A surface heating material as set forth in claim 27 wherein the contact terminals are positioned within the plurality of fiber strands.

30. A surface heating material as set forth in claim 29 wherein the contact terminals are woven in the plurality of fiber strands.

31. A surface heating material as set forth in claim 27 further comprising a cover covering the flexible conductive heating layer.

32. A surface heating material as set forth in claim 27, wherein the air permeable support is molded to form a portion of a mattress, a seat cushion, or a seat back.

* * * * *